US011524423B2

(12) United States Patent
Li

(10) Patent No.: US 11,524,423 B2
(45) Date of Patent: Dec. 13, 2022

(54) CHAIN SAW

(71) Applicant: Globe (Jiangsu) Co., Ltd, Jiangsu (CN)

(72) Inventor: Xiazi Li, Jiangsu (CN)

(73) Assignee: Globe (Jiangsu) Co., Ltd, Changzhou (CN)

( * ) Notice: Subject to any disclaimer, the term of this patent is extended or adjusted under 35 U.S.C. 154(b) by 89 days.

(21) Appl. No.: 17/074,566

(22) Filed: Oct. 19, 2020

(65) Prior Publication Data

US 2021/0114249 A1 Apr. 22, 2021

(30) Foreign Application Priority Data

Oct. 18, 2019 (CN) ..... 201910993068.7
Oct. 18, 2019 (CN) ..... 201910993078.0
Oct. 18, 2019 (CN) ..... 201910993428.3

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01)

(58) Field of Classification Search
CPC ..... B27B 17/14; B27B 17/02; B27B 17/00
USPC ..... 30/386
See application file for complete search history.

(56) References Cited

U.S. PATENT DOCUMENTS 3,116,892 A * 1/1964 Pickard ..... A01K 89/017 242/255
6,564,459 B1 5/2003 Steinbrueck et al.
2011/0287887 A1* 11/2011 Zhou ..... B27B 5/32 475/331
2011/0308096 A1* 12/2011 Yu ..... B27B 17/14 30/386
2017/0043421 A1 2/2017 Nie et al.
2017/0204949 A1* 7/2017 Dunn ..... F16H 19/0622
(Continued)

FOREIGN PATENT DOCUMENTS

CN 201353802 Y * 12/2009
CN 201353802 Y 12/2009
(Continued)

OTHER PUBLICATIONS

Extended European Search Report of Counterpart European Patent Application No. 21192415.4 dated Jan. 14, 2022.
(Continued)

*Primary Examiner* — Nhat Chieu Q Do

(57) ABSTRACT

A chain saw has a housing, a guiding plate, a chain, a power system and a tensioning component. The tensioning component includes a knob, a driving member and a transmission assembly. When the chain is in a loose state, the knob is forced to rotate and drives the transmission assembly to rotate, and the transmission assembly drives the driving member to rotate, then the driving member drives the guiding plate to move to tension the chain. When the chain is in an extension state, the knob is forced to rotate, the driving member stays still, and a skidding inside the tensioning component is generated. The tensioning component of the chain saw of the present invention can tension the chain and fix the guiding plate by rotating the knob, the operation is simple and convenient; Meanwhile, the tensioning component avoids over-tensioning the chain by skidding inside.

8 Claims, 11 Drawing Sheets

(56) References Cited

U.S. PATENT DOCUMENTS

| | | | | |
|---|---|---|---|---|
| 2018/0281225 | A1 | 10/2018 | Gerstenberger et al. | |
| 2022/0142304 | A1* | 5/2022 | Chen | B65H 75/4421 |

FOREIGN PATENT DOCUMENTS

| | | | | |
|---|---|---|---|---|
| CN | 101758520 | A | | 6/2010 |
| CN | 203282549 | U | | 11/2013 |
| CN | 203282550 | U | | 11/2013 |
| CN | 203496055 | U | | 3/2014 |
| CN | 104209987 | A | | 12/2014 |
| CN | 204755795 | U | | 11/2015 |
| CN | 105134894 | A | | 12/2015 |
| CN | 204975540 | U | | 1/2016 |
| CN | 205852983 | U | | 1/2017 |
| CN | 211362619 | U | | 8/2020 |
| CN | 212338099 | U | * | 1/2021 |
| DE | 9311081 | U1 | | 11/1994 |
| EP | 2366513 | A1 | | 9/2011 |
| JP | 2013166251 | A | | 8/2013 |

OTHER PUBLICATIONS

Search Report of Counterpart European Patent Application No. 20202674.6 dated Feb. 25, 2021.

* cited by examiner

CHAIN SAW

CROSS-REFERENCE TO RELATED INVENTIONS

This invention claims the priorities of CN invention Serial No. CN201910993078.0, CN invention Serial No. CN201910993068.7, and CN invention Serial No. CN201910993428.3, all filed on Oct. 18, 2019, the disclosures of which are hereby incorporated by reference in their entirety.

TECHNICAL FIELD

The invention relates to a chain saw, especially to a tensioning component for a chain of the chain saw.

BACKGROUND ART

An electric chain saw having a saw chain driven by an electric motor to rotate at a high speed is known as a common garden tool for cutting wood or branches. If the chain is loose, the chain may jump off the guiding plate in operation and injure the operator; if the chain is subjected to high mechanical stresses, the chain may experience high temperature failure due to excessive friction with the guiding plate and this also increases the risks of breakage. Moreover, the chain will be worn out over time, and the mechanical stress on the chain will be gradually reduced. Thus, it is necessary to tension the chain with appropriate stress on demand.

There are different kinds of existing configurations for tensioning the chain. In one conventional arrangement, a tensioning assembly including an adjusting screw and a clamping nut is used to tension the chain, but it requires the operator to carry special tools to perform the tightening operation, which causes inconvenience. In another arrangement, a knob is used to drive a series of adjustment components to tension the chain, the operator can rotate the knob by hand and no special tool is required. However, the arrangements described above have significant disadvantages. Because the adjustment operation of the tension of the chain mainly depends on the operator's experience, and it is difficult to control the mechanical stress exerted on the chain. Additionally, tensioning the chain and fixing the guiding plate are finished by two separate operation steps. If the adjustments of the tension are not in place, repeating steps are needed in order, which causes inconvenient in the operation procedure.

In view of the above problems, it is necessary to provide a chain saw to solve the above problems.

SUMMARY OF INVENTION

The present invention provides a chain saw with a tensioning device that is convenient to operate, and the tensioning device can skid when the chain is in an extension state to avoid the over-tension in the chain.

To achieve the above object, the present invention adopts the following technical solution: a chain saw, comprises a housing; a guiding plate installed on the housing and being movable forward and backward relatively to the housing; a chain arranged around the guiding plate; a power system installed on the housing and driving the chain; and a tensioning component comprising a knob, a driving member and a transmission assembly arranged between the knob and the driving member; wherein, when the chain is in a loose state, the knob is forced to rotate and drives the transmission assembly to rotate, the transmission assembly then drives the driving member to rotate, and the driving member drives the guiding plate to move to tension the chain; when the chain is in an extension state, the knob is forced to rotate, the driving member stays still, and a skidding inside the tensioning component is generated.

As a further improvement of the invention, the skidding inside the tensioning component is generated between the transmission assembly and the knob, or between the transmission assembly and the driving member, or between parts of the transmission assembly.

As a further improvement of the invention, the knob comprises a pin with a thread hole, the housing comprises a bolt passing through the guiding plate, and the pin is in threaded connection with the bolt to fix the tensioning component to the housing; and wherein when the chain is in the extension state, rotating the knob enables the pin tightly pressing the guiding plate.

As a further improvement of the invention, the transmission assembly includes a bracket and a plurality of elastic modules, the bracket includes a plurality of through holes for accommodating the plurality of elastic modules respectively, the elastic module includes an elastic member and a ball; wherein, the knob comprises an end wall with a plurality of inner teeth arranged on an inner surface thereof, a positioning groove is arranged between two adjacent inner teeth, and wherein the ball is pushed by the elastic member to latch with the positioning groove.

As a further improvement of the invention, the elastic module includes an adjustment block received in the through hole, and an end of the elastic member opposite to the knob is pressed against the adjustment block, and wherein the position of the adjustment block is adjustable.

As a further improvement of the invention, the knob includes a pin with an end passing through the transmission assembly and the driving member, and the end is sheathed with a retaining ring.

As a further improvement of the invention, the transmission assembly includes a bracket and an elastic member, the knob comprises an end wall and a plurality of inner teeth on an inner surface of the end wall, and the bracket comprises a plurality of meshing end teeth engaging with the inner teeth.

As a further improvement of the invention, the bracket comprises a positioning rod, and the elastic member is sleeved on the positioning rod.

As a further improvement of the invention, the transmission assembly comprises an adjustment block, the knob comprises a pin projecting inwardly from the middle of the end wall and passing through the positioning rod, the adjustment block is arranged on an end of the pin, and the elastic member is arranged between the bracket and the adjustment block.

As a further improvement of the invention, the driving member comprises a center hole aligned with the adjustment block along an extending direction of the pin.

As a further improvement of the invention, a rib is arranged on a peripheral wall of the knob, and a groove matching with the rib is arranged on an outer wall of the bracket, the rib latches with the groove when the knob is engaging with the bracket.

As a further improvement of the invention, the rib comprises two opposite side walls extending along an axis of the knob, an angle between the side wall and the peripheral wall of the knob is greater than 80 degrees.

As a further improvement of the invention, the transmission assembly comprises a releasing block, an elastic member and a gear set, the releasing block engages with the knob, and the elastic member is arranged between the knob and the releasing block, the releasing block comprises a plurality of inner teeth, and the gear set comprises a plurality of outer teeth; when the chain is in the loose state, the knob drives the releasing block to rotate, and the releasing block drives the gear set to rotate through the cooperation of the inner teeth and the outer teeth, then the gear set drives the driving member to rotate; when the chain is in the extension state, the skidding inside the tensioning component is generated between the inner teeth and the outer teeth.

As a further improvement of the invention, the gear set comprises a sun gear pivot mounted on the knob and at least one planetary gear pivot mounted on the driving member, the knob is arranged outside the gear set, and an inner ring gear is arranged on an inner wall of the knob for matching with the at least one planetary gear.

As a further improvement of the invention, the gear set comprises a bracket arranged outside the planetary gear, at least one gap is arranged on a side wall of the bracket, an outer side of the planetary gear protrudes out of the at least one gap to mesh with the planetary gear.

As a further improvement of the invention, the knob comprises a resisting block, and the releasing block comprises a resisting groove engaging with the resisting block.

As a further improvement of the invention, the driving member comprises at least one spiral guiding rail, or, the driving member is configured to a one-way cam or a two-way cam, and wherein the guiding plate comprises a guiding rail groove and a positioning plate, the positioning plate comprises protrusions matched with the driving member.

As a further improvement of the invention, the transmission assembly comprises a bracket, and the bracket is fixed to the driving member by a plurality of fasteners.

The above general description and the following detailed description are intended to be illustrative and not restrictive.

DESCRIPTION OF EMBODIMENT

The exemplary embodiment will be described in detail herein, and the embodiment is illustrated in the accompanying drawings. When the following description refers to the drawings, unless otherwise indicated, the same numbers in different drawings indicate the same or similar elements. The embodiment described in the following exemplary embodiment does not represent all embodiments consistent with the present invention. On the contrary, they are only examples of devices, systems, machines and methods consistent with some aspects of the invention as detailed in the appended claims.

The First Implementation

Figure 1:
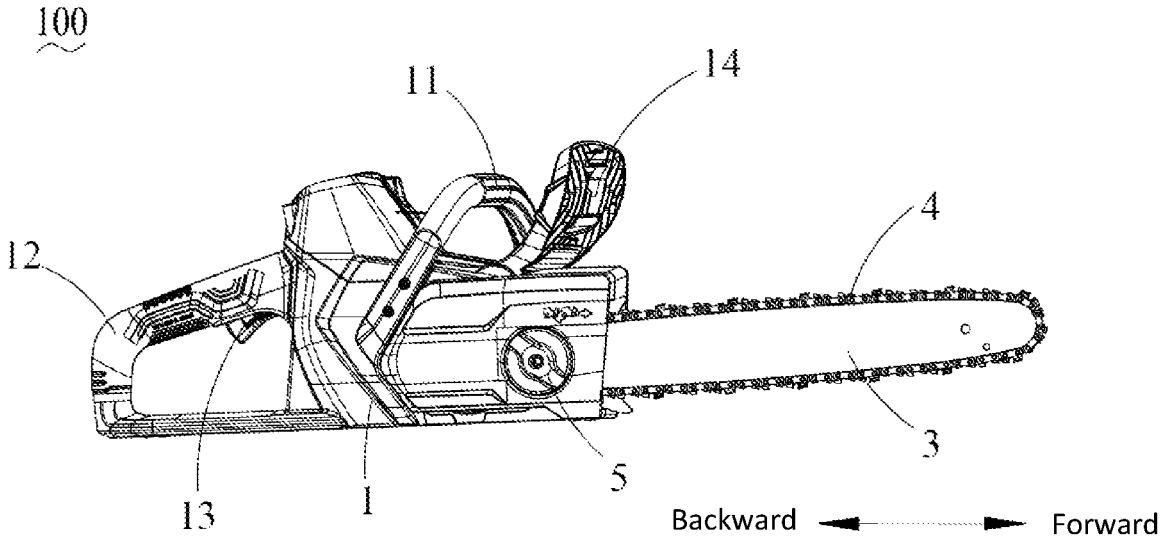
FIG. 1 is a perspective view of a first chain saw according to the first embodiment of the present application.
Figure 2:
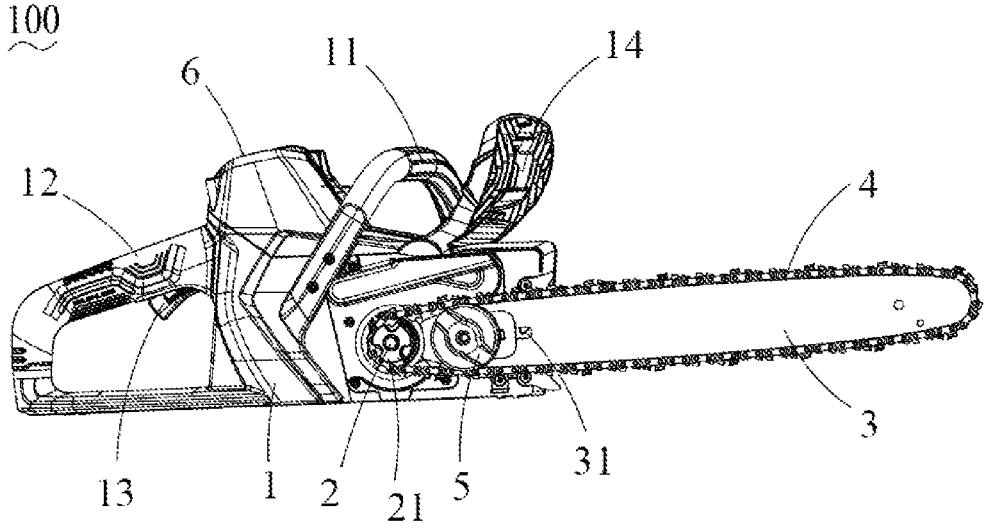
FIG. 2 is a perspective view of the first chain saw in FIG. 1 with a housing partially removed.
Figure 3:
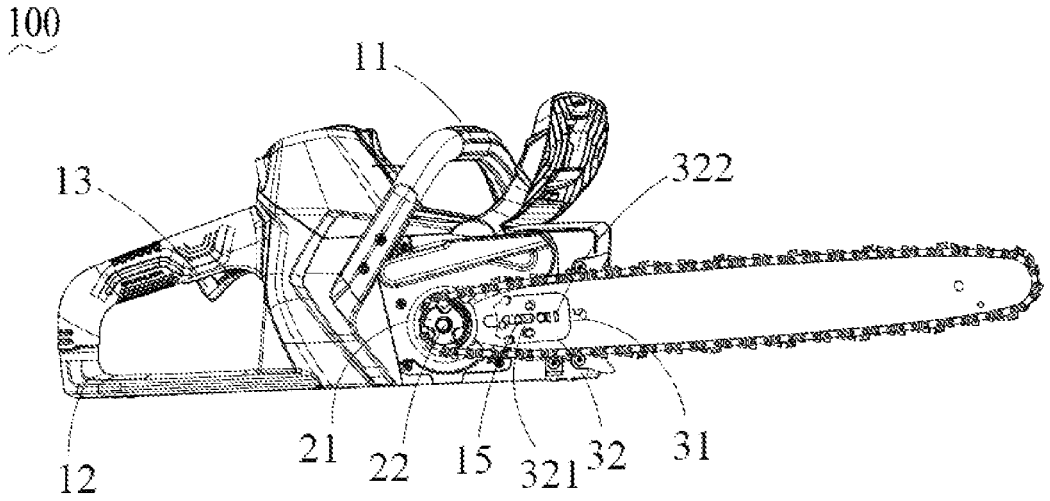
FIG. 3 is a perspective view of the first chain saw in FIG. 2, wherein a first tensioning component is removed.
Figure 4:
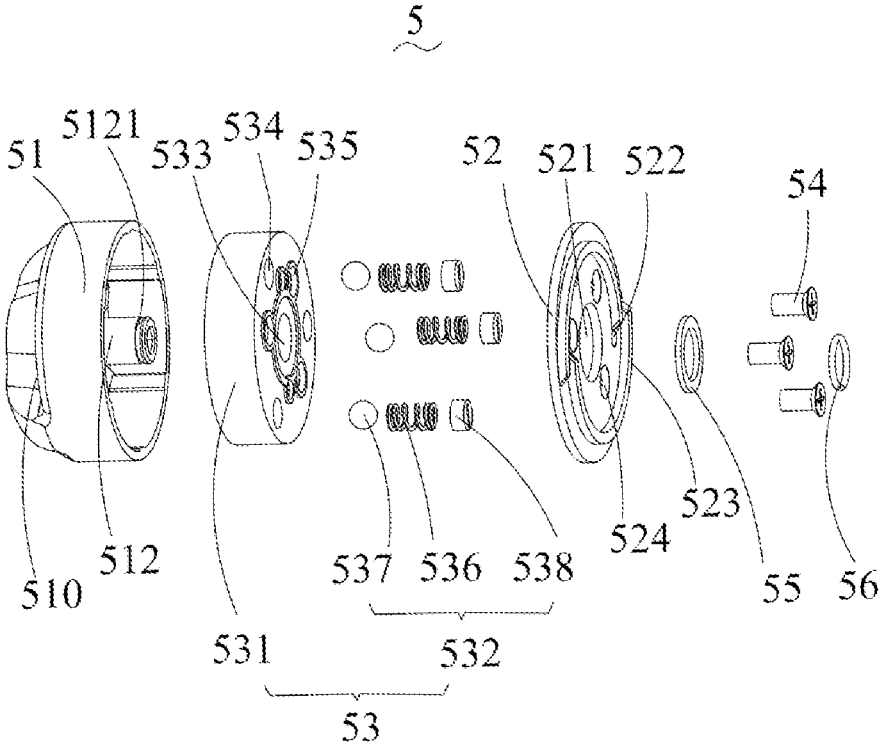
FIG. 4 is a perspective exploded view of the first tensioning component.
Figure 5:
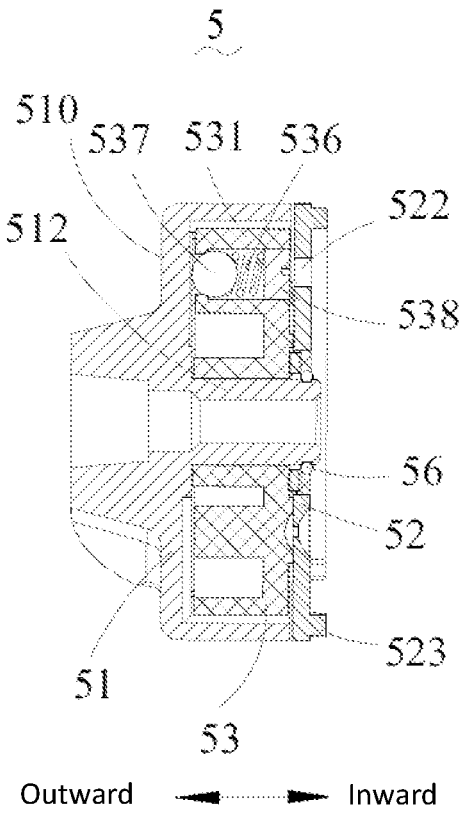
FIG. 5 is a sectional view of the first tensioning component.
Figure 6:
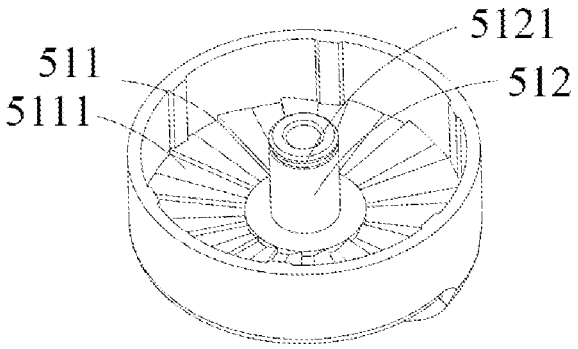
FIG. 6 is a perspective view of a first knob of the first tensioning component.
Figure 7:
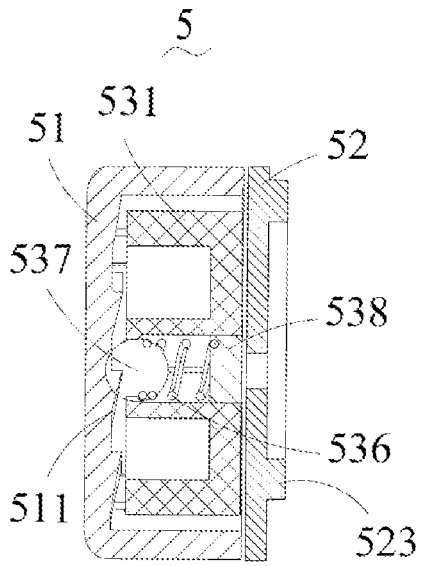
FIG. 7 is another sectional view of the first tensioning component.
Figure 8:
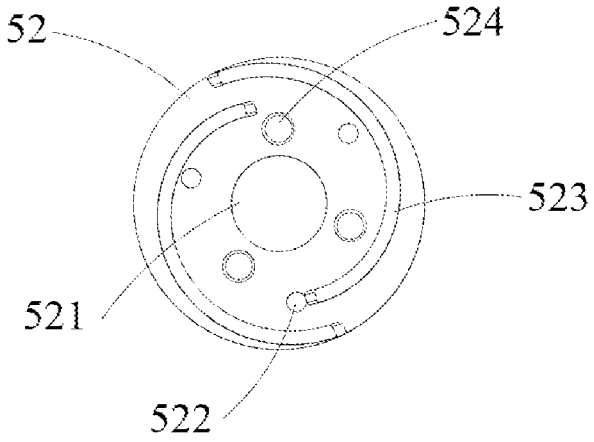
FIG. 8 is a bottom view of a first driving member of the first tensioning component.
Figure 9:
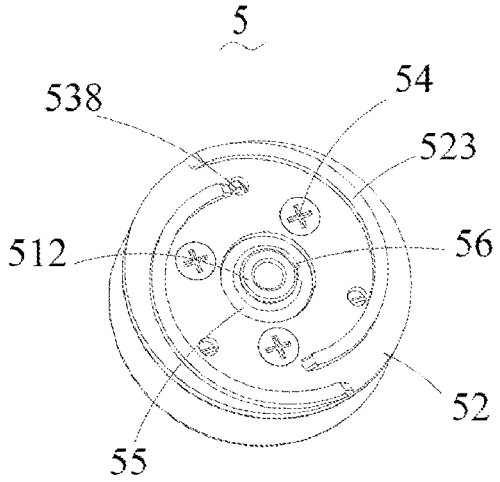
FIG. 9 is a perspective assembled view of the first tensioning component, taken from the bottom side.

Referring to FIG. 1 to FIG. 3, a first chain saw 100 according to the first embodiment of the present invention includes a housing 1, a power system 2, a guiding plate 3, a chain 4, and a first tensioning component 5. The power system 2 is installed in the housing 1, the guiding plate 3 is installed on the housing 1 and is movable forward and backward relatively to the housing 1, the chain 4 is arranged around the edge of the guiding plate 3 and can be driven to move by the power system 2, and the first tensioning component 5 is used for tensioning the chain 4.

The housing 1 includes a first housing (not labeled) and a second housing (not labeled) that are engaged with each other, and the first housing and the second housing enclose a receiving space for accommodating the power system 2. The housing 1 also includes a front handle 11, a rear handle 12, and a trigger 13. The trigger 13 is arranged on the rear handle 12 to control the power system 2. The front handle 11 and the rear handle 12 can be hold by the operator, and the trigger 13 can be pulled to operate the first chain saw 100.

The first chain saw 100 also includes a protective plate 14 rotatably connected to the housing 1 and a brake device (not shown) cooperating with the protective plate 14. When the protective plate 14 is rotated, the brake device can be activated and further control the power system 2 to stop working, so as to prevent accidents of the first chain saw 100 in operation. Preferably, the brake device is a mechanical brake mechanism or an electronic brake mechanism or a mechanical and electronic combined brake mechanism, which is not limited here.

The first chain saw 100 includes a sprocket 21 engaging with the chain 4, the chain 4 rotates with the sprocket 21 driven by the power system 2. The first chain saw 100 also comprises an energy supply unit 6, in this embodiment, the energy supply unit 6 is a battery pack detachably mounted on the housing 1, and the power system 2 is an electrical motor and is powered by the battery pack. Of course, in other embodiments of the present invention, the first chain saw 100 can be powered by another energy supply unit 6, such as an external power supply, an internal combustion engine, etc.

The guiding plate 3 is detachably installed on the housing 1 by the first tensioning component 5, the guiding plate 3 is movable forward and backward relatively to the housing 1 by adjusting the first tensioning component 5. The guiding plate 3 moves forwardly to tension the chain 4, and moves rearward to loose the chain 4.

Referring to FIG. 2 and FIG. 3, the guiding plate 3 comprises a guiding groove 31 extending in the forward and backward direction and a positioning plate 32 fixed to the guiding plate 3. The positioning plate 32 comprises a through groove 321 corresponding to the guiding groove 31, and a plurality of protrusions 322. The protrusions 322 are disposed on a side of the positioning plate 32 adjacent to the first tensioning component 5, and are arranged staggered in a forward and backward direction. The first tensioning component 5 cooperates with the protrusion 322 to drive the guiding plate 3 to move back and forth, details will be described later.

Please referring to FIG. 4 to FIG. 9, the first tensioning component 5 comprises a first knob 51, a first driving member 52, and a first transmission assembly 53 connecting the first knob 51 with the first driving member 52. In the present embodiment, the first knob 51 is an outer knob, and is roughly in the shape of a cylinder with an opening on one side. The first knob 51 comprises a first end wall 510 and a plurality of first inner teeth 511 arranged on an inner surface of the first end wall 510, and a first pin 512 protruding inwardly from a middle of the first end wall 510. Two neighbouring first inner teeth 511 define a positioning groove 5111 therebetween. Wherein the inward direction herein is a direction from the first knob 51 to the first driving member 52 and the first transmission assembly 53.

The first pin 512 can pass through the first driving member 52 and the first transmission assembly 53 and has a smooth outer surface, the first pin 512 comprises a threaded hole therein along its axial direction. The housing 1 comprises a bolt 15, the bolt 15 passes through the guiding groove 31 on the guiding plate 3 and the through groove 321 on the positioning plate 32, and the first pin 512 passes through the housing 1 inwardly for threaded connection with the bolt 15, so that the first tensioning component 5 is detachably mounted to the housing 1 and simultaneously retain the guiding plate 3 to the housing 1. When the first knob 51 rotates, and the first pin 512 will synchronously move toward the guiding plate 3 to clamp the guiding plate 3, so as to ensure the guiding plate 3 maintaining stable in use.

Referring to FIG. 4 to FIG. 9, the first driving member 52 is used to engage with the protrusions 322 to drive the guiding plate 3 moving forward or backward, so as to exert more or less mechanical stress on the chain 4. The first driving member 52 comprises an accommodating hole 521 for receiving the first pin 512, and at least one first spiral guiding rail 523 arranged on a side of the first driving member 52 close to the guiding plate 3. The quantity of first spiral guiding rails 523 is at least one, preferably two.

The first spiral guiding rail 523 is arranged correspondingly to the protrusions 322 on the positioning plate 3. When the first tensioning component 5 is assembled, the first spiral guiding rail 523 is clamped between two adjacent protrusions 322, when the first driving member 52 driven by the first knob 51 to rotate, the first spiral guiding rail 523 slides between the two adjacent protrusions 322 and pushes against corresponding protrusion 322 so as to drive the guiding plate 3 to move back and forth, and the chain 4 is tensioned or loosened.

The first transmission assembly 53 includes a first bracket 531 and a plurality of elastic modules 532. The first bracket 531 comprises a receiving hole 533 for receiving the first pin 512 and a plurality of through holes 534 arranged around the elastic modules 532. The elastic modules 532 are received in the through holes 534 and detachably connected with the first knob 51.

The first bracket 531 further includes a plurality of blind holes 535, which are offset from the through holes 534, and the first driving member 52 includes a plurality of positioning holes 524 correspondingly. The first driving member 52 and the first bracket 531 are connected together as a whole by a plurality of first fasteners 54 passing through the positioning holes 524 and corresponding blind holes 535, so as to rotate together with the first knob 51. In this embodiment, the blind holes 535 and the positioning holes 524 are evenly distributed along a circumference, and the quantity of each is three. In other embodiments, the quantity of blind holes 535 and the positioning holes 524 may be one or another number.

The elastic module 532 includes a first elastic member 536, a ball 537 and a first adjusting block 538, and the first elastic member 536 is disposed between the ball 537 and the first adjusting block 538. The ball 537 is abutted against the first knob 51 by the first elastic member 536 and partially exposed from the through hole 534 to engage with the positioning groove 5111 of the first knob 51. Preferably, a distance of the ball 537 projecting out of the first bracket 531 is one third of the diameter of the ball 537. In the first embodiment, the first elastic member 536 is a spring, however, in other embodiments, the first elastic member 536 may be a plastic elastic member, an elastic sheet, etc. In the first embodiment, the ball 537 is a steel ball, of course, it can also be formed by other suitable material in suitable shape.

Furthermore, the first adjusting block 538 is also received in the through hole 534, the first adjusting block 538 is in threaded connection with an inner wall of the through hole 534, and the position of the first adjusting block 538 is adjustable. The force applied by the first elastic member 536 on the ball 537 is decreased as the first elastic member 536 worn out over long time usage, at this time, the operator can adjust the position of the first adjusting block 538 to shorten the length of the first elastic member 536 to enhance the force, so as to maintain the force at a certain value, preferably, about 20N.

The first driving member 52 also includes a plurality of through slots 522 corresponding to the through holes 534. One end of the first adjusting block 538 is exposed from the through hole 534 and passes through the through slot 522, so that the operator can easily adjust the position of the first adjusting blocks 538 in the through slots 522 and the through holes 534.

In this embodiment, there are three elastic modules 532. Three corresponding through holes 534 and three corresponding through slots 522 are respectively and evenly distributed along the circumference. In other embodiments, the quantity of through holes 534 and the through slots 522 may be one or other numbers.

The first tensioning component 5 further includes a flat washer 55 and a first retaining ring 56. A first locking groove 5121 corresponding to the first retaining ring 56 is arranged on a bottom of the first pin 512. Specifically, when assembling the first tensioning component 5, firstly, the first driving member 52 is assembled to the first bracket 531 of the first transmission assembly 53 by the first fasteners 54; secondly, the first pin 512 of the first knob 51 passes through the receiving hole 533 of the first bracket 531, the accommodating hole 521 of the first driving member 52, the flat washer 55 and the first retaining ring 56 in order, and the first retaining ring 56 is clamped in the first locking groove 5121, then the first knob 51, the first transmission assembly 53, and the first driving member 52 are integrated, and the first tension assembly 5 is assembled. When finished assembling, the first elastic member 536 is in a compressed state, and the ball 537 engages with the positioning groove 5111 of the first knob 51 under the elastic force of the first elastic member 536. As shown in FIG. 3, the first pin 512 of the first tensioning component 5 is in threaded connection with the bolt 15 secured on the housing 1 to mount the first tensioning component 5 to the housing 1 and fasten the guiding plate 3 onto the housing 1.

When the first chain saw 100 of the present invention is in use, if the chain 4 is in a loose state, the first knob 51 is rotated by the operator, and the first knob 51 drives the first transmission assembly 53 and the first driving member 52 connected with the first bracket 531 to rotate, due to the first inner teeth 511 of the first knob 51 engaging with the ball 537. The first spiral guiding rail 523 of the first driving member 52 abuts against the protrusion 322 on the positioning plate 32 and bring the guiding plate 3 to move forward, so as to tension the chain 4. When the chain 4 is in a tensioned state, the first knob 51 is continually rotated, the first driving member 52 stays still, a resistance applied by the guiding plate 3 on the first driving member 52 is greater than a driving force of the first transmission assembly 53 applied on the first driving member 52, skidding occurs between the positioning groove 5111 and the ball 537 of the first transmission assembly 53, and then a clicking sound is generated. At this time, the first bracket 531 and the first driving member 52 will not rotate with the first knob 51, and the chain 4 is avoided to be excessive tensioned.

When the chain 4 is in a loose state, the first pin 512 of the first knob 51 does not press against the guiding plate 3; and when the first knob 51 is continually rotated after the chain 4 is tensioned, an end of the first pin 512 starts to contact and press the guiding plate 3 to tighten the guiding plate 3 until the first knob 51 is tightened. Therefore, rotating the first knob 51 can not only tension the chain 4 but also enable the guiding plate 3 to be compressed against the housing.

The tension of the chain 4 is calculated according to the spiral equation. The eccentricity of a 180-degree single spiral of the first spiral guiding rail 523 is 2 mm-10 mm, and the spiral guiding rail 523 with double spirals can find the meshing point more effectively.

Figure 10:
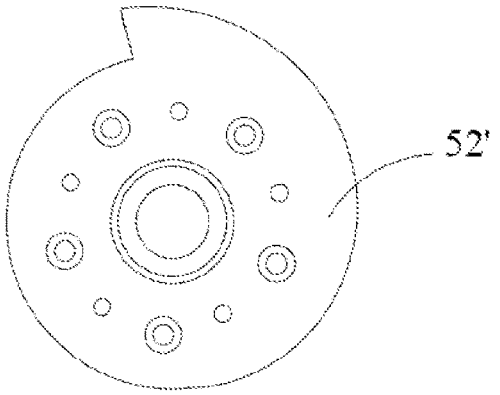
FIG. 10 is an alternative embodiment of the first driving member.
Figure 11:
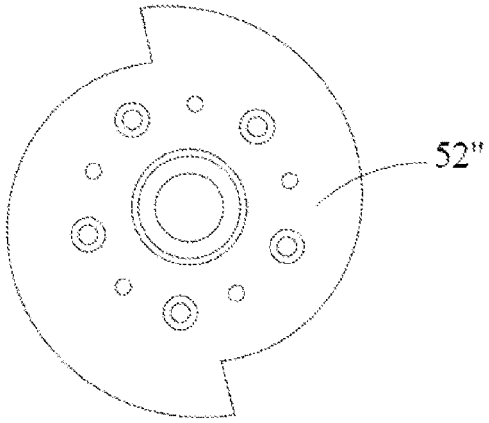
FIG. 11 is another alternative embodiment of the first driving member.

It should be noted that, in this embodiment, only the first driving member 52 including the first spiral guiding rail 523 is taken as an example for illustration. In other embodiments of the present invention, other eccentric rotation mechanism, such as one-way cam 52' (FIG. 10) or two-way cam 52" (FIG. 11), can replace the first driving member 52 in present embodiment, corresponding installation manner is the same as that of the present invention, the only difference is that when the first driving member 52 is the one-way cam 52' or the two-way cam 52", the number of protrusions 322 on the positioning plate 32 is set to only one, other structure and working principle are the same as the above, so it will not be repeated here.

It should be noted that the embodiment of the transmission assembly in the present invention may also be combination. For example, the transmission assembly may include a first friction member that rotates synchronously with the first knob 51 and a second friction member that rotates synchronously with the first driving member 52, and the first friction member resists the second friction member. When the static friction force between the first friction member and the second friction member is greater than the force on the first driving member 52 applied by the chain 4, the transmission assembly transmits torque; when the static friction force between the first friction member and the second friction member is smaller than the force of the chain 4 applied on the first driving member 52, skidding occurs between the first friction member and the second friction member, and the first transmission assembly stops transmitting torque.

Alternatives to the First Embodiment

It is understood that if the ball 537 of the first transmission assembly 53 is arranged at the end of the first elastic member 536 close to the first driving member 52, the positioning groove 5111 is arranged on the first driving member 52, and the first fasteners 54 fix the first transmission assembly 53 and the first knob 51. When the chain 4 is in the loose state, the first knob 51 is rotated and drives the first transmission assembly 53 and the first driving member 52 to rotate; when the chain 4 is in a tensioned state, the first knob 51 is continually rotated and drives the first transmission assembly 53 to rotate, but the first driving member 52 stays still, the skidding occurs between the ball 537 and the positioning groove 5111 skid, i.e. the skidding occurs between the first transmission assembly 53 and the first driving member 52, and the force exerted by the first knob 51 on the chain can be released, and this configuration can also avoid excessive tension of the chain 4.

The Second Implementation

Figure 12:
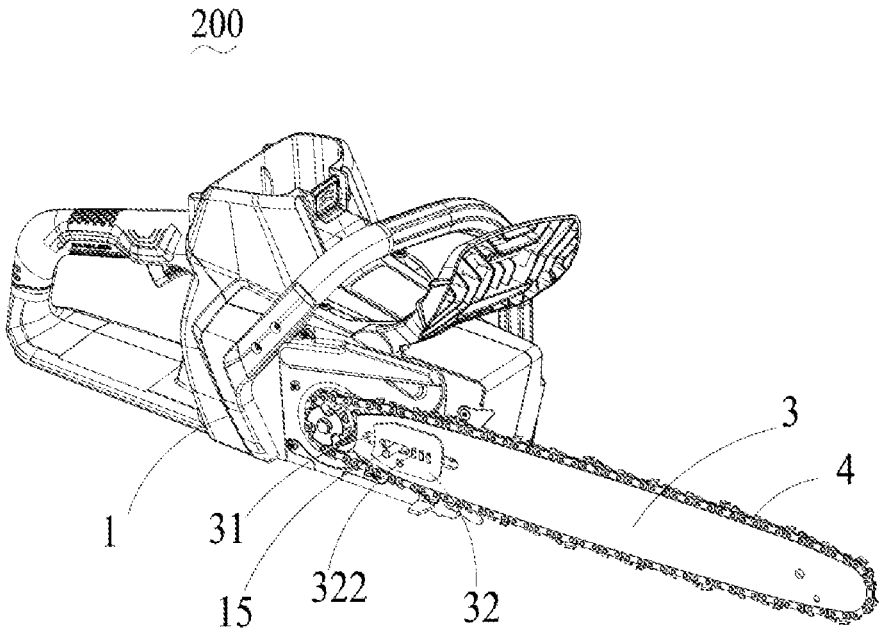
FIG. 12 is a perspective view of a second chain saw according to the second embodiment of the present application, wherein a second tensioning component is removed.
Figure 13:
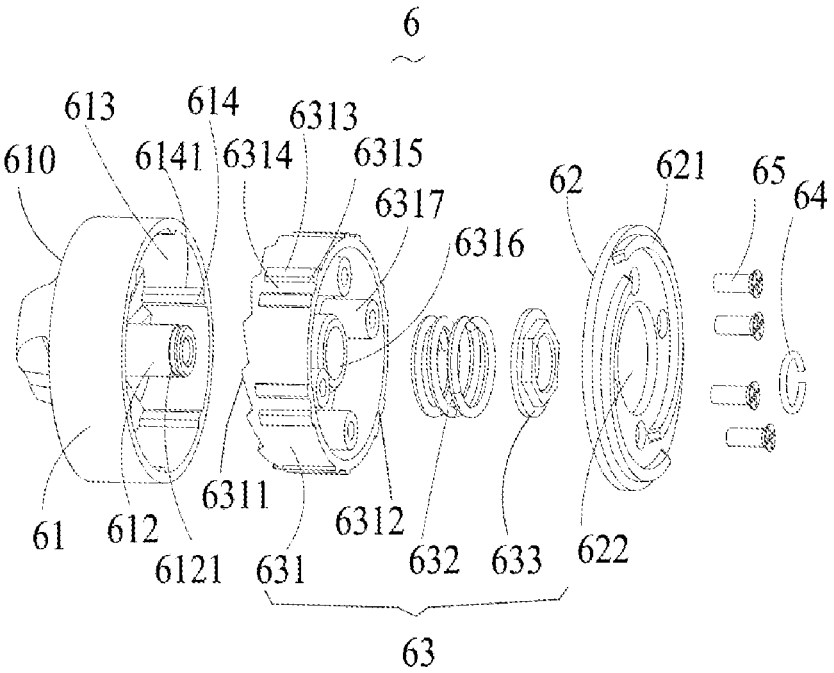
FIG. 13 is a perspective exploded view of the second tensioning component.
Figure 14:
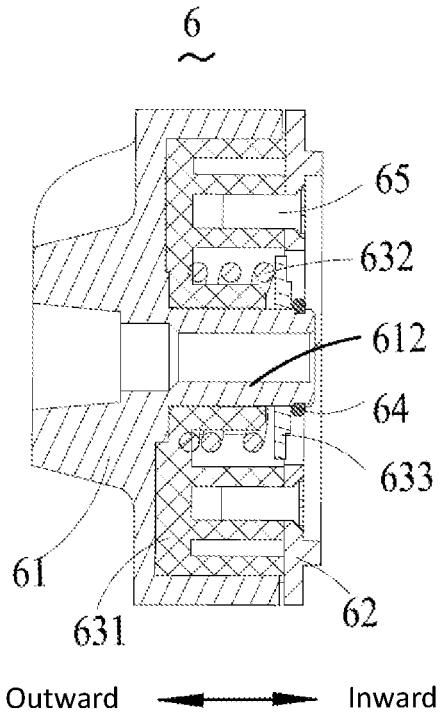
FIG. 14 is a sectional view of the second tensioning component.
Figure 15:
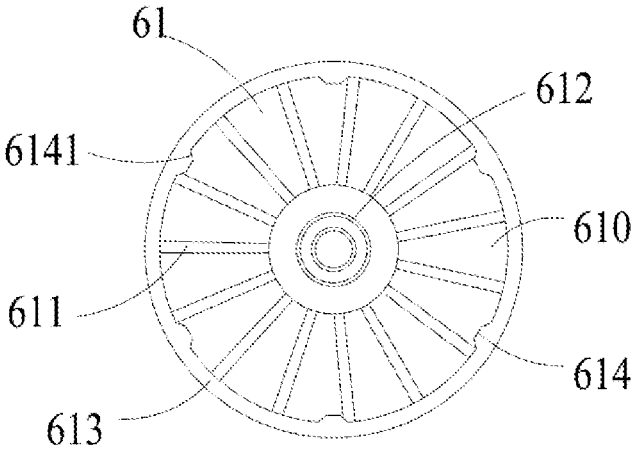
FIG. 15 is a bottom view of a second knob of the second tensioning component.
Figure 16:
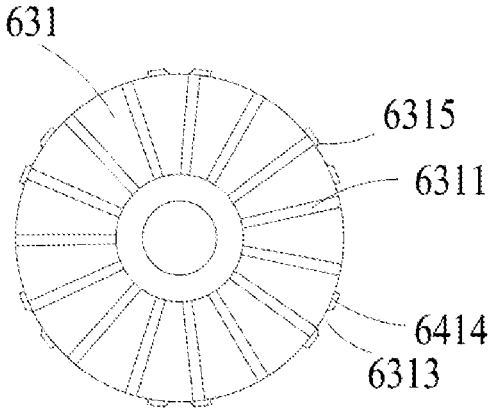
FIG. 16 is a top view of a second bracket of the second tensioning component.
Figure 17:
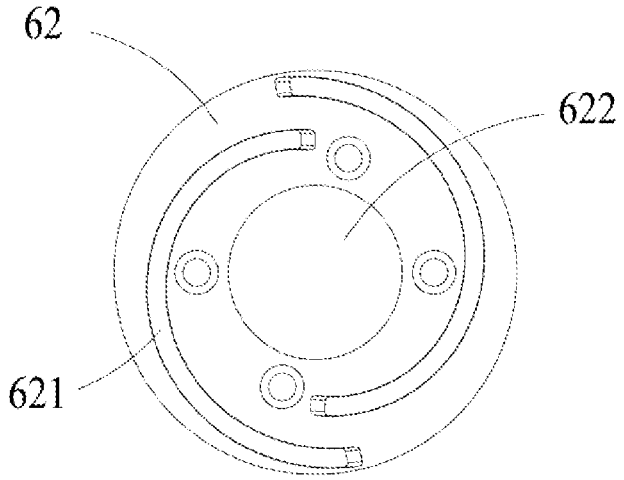
FIG. 17 is a bottom view of a second driving member of the second tensioning component.

The present invention also provides a second chain saw 200 according to second embodiment. Referring to FIG. 12 and FIG. 13, the second chain saw 200 comprises a second tensioning component 6, which drives the guiding plate 3 to move back and forth to tension the chain saw 4. Wherein, except for the second tensioning component 6 is different from the first tensioning component 5 of the first chain saw 100, other structures of the second chain saw 200 is substantially the same as that of the first chain saw 100. For being understanding easily, the second chain saw 200 uses the same numeral labels for its structures as the first chain saw 100 in the first embodiment except the tensioning component, and an assembled perspective view of the second chain saw 200 can refer to FIG. 1.

Referring to FIG. 13 to FIG. 17, the second tensioning component 6 includes a second knob 61, a second driving member 62 and a second transmission assembly 63. The second knob 61 is detachably connecting with the second transmission assembly 63, and can drive the second transmission assembly 63 to rotate together. The second transmission assembly 63 transmits the rotational movement of the second knob 61 to the second driving member 62, and the second driving member 62 abuts against the protrusion 322 of the positioning plate 32 to drive the guiding plate 3, so as to tension the chain 4. When the chain 4 is in a tensioned state, the second knob 61 and the second transmission assembly 63 skid therebetween to release the driving force applied to the second knob 61 and stop the torque transmission. The structure and working principle of the second tensioning component 6 are roughly similar to that of the first tensioning component 5 in the first embodiment, and the main difference is that the connection between the second knob 61 and the second transmission assembly 63 is different from that of the first knob 51 and the first transmission assembly 53.

The second knob 61 has a cylindrical shape, and comprises a second end wall 610. A plurality of inner teeth 611 are arranged on an inner side of the second end wall 610, and a second pin 612 extending from a center of the second end wall 610. The second pin 612 comprises threaded holes for threaded connection with the bolt 15 on the housing 1. The second tensioning component 6 is fixed to the housing 1 in the same manner as the first tensioning component 5.

The second transmission assembly 63 includes a second bracket 631, which comprises meshing end teeth 6311 on a top thereof. After the second knob 61 and the second transmission assembly 63 are assembled, the second inner teeth 611 engages with the meshing end teeth 6311 so that the second knob 61 can drive the second transmission assembly 63 to rotate together.

The second knob 61 includes a peripheral wall 613, which comprises a plurality of ribs 614 on an inner surface thereof. The ribs 614 extends along an axial direction of the second knob 61, that is an extending direction of the second pin 612. The ribs 614 comprises two opposite side walls 6141, which are inclined walls. The angle between each side wall 6141 and the peripheral wall 613 of the second knob 61 is greater than 80 degrees.

The second bracket 631 comprises an outer wall 6312, which comprises a plurality of grooves 6313 on an outer surface thereof, and each groove 6313 is defined by two adjacent ribs 6314 protruding from the outer wall 6312. When the second knob 61 and the second transmission assembly 63 are assembled together, the ribs 614 are locked in the grooves 6313. The groove 6313 comprises two opposite side end walls 6315, which are also inclined walls. The angle between each wall 6315 and the outer wall 6312 of the second transmission assembly 63 is greater than 80 degrees. In other words, the two side end walls 6315 of the grooves 6313 are matched with the two side walls 6141 of the ribs 614, respectively. In this embodiment, the quantity of the ribs 614 is preferably six, and the quantity of the grooves 6313 is correspondingly preferably six.

The second bracket 631 comprises a positioning rod 6316 for the second pin 612 of the second knob 61 passing through on a center thereof, and the second bracket 631 further comprises a plurality of the screw posts 6317 which are evenly distributed around the positioning rod 6316. The second tensioning component 6 comprises a plurality of second fasteners 65 passing through the second driving member 62 and fixing to the screw posts 6317, so that the second driving members 62 and the second transmission assembly 63 are connected as a whole to rotate with the second knob 61.

The second transmission assembly 63 includes a second elastic member 632 and a second adjustment block 633, which are both received in the second bracket 631. The second elastic member 632 is sleeved on the positioning rod 6316 of the second bracket 631, an end of the second pin 612 extends beyond the positioning rod 6316, the second adjustment block 633 is mounted to the end of the second pin 612, then the second elastic member 632 is located between the bracket 631 and the second adjustment block 633 to push the second bracket 631 toward the second knob 61, so that the second knob 61 can be detachably fit with the second bracket 631.

The second adjustment block 633 is arranged outside the second pin 612 through a threaded connection, adjusting the position of the second adjustment block 633 can adjust an elastic compression degree of the second elastic member 632. When the second elastic member 632 is fatigued after long-term use, an elastic force on the second bracket 631 applied by the second bracket 631 is reduced. Then the position of the second adjustment block 633 can be adjusted to shorten a compressed length of the second elastic member 632 to keep the force applied by the second elastic member 632 on the second bracket 631 at a certain value, so as to maintain the best cooperation between the second knob 61 and the second transmission assembly 63, the force is preferably 20N. In this embodiment, the second elastic member 632 is a spring, but in other embodiments, the second elastic member 632 may be a plastic elastic member, an elastic sheet, or the like.

In present embodiment, compared with the elastic modules 532 in the first embodiment, the second elastic member 632 eliminates the balls and comprises the meshing end teeth 6311 on a top thereof for matching with the second inner teeth 611 of the second knob 61. The corresponding arrangement of the second elastic member 632 and the second adjustment block 633 is also correspondingly configured as suitable configurations.

The second driving member 62 is in the shape of a disc, and comprises a second spiral guiding rail 621 disposed on a side of the second driving member 62 opposite to the second knob 61, and the second spiral guiding rail 621 is engaged with the protrusion 322. The positioning plate 32 comprises at least two protrusions 322, and the second spiral guiding rail 621 is located between the two protrusions 322. The number of the second spiral guiding rails 621 is set to at least one, preferably two. The second spiral guiding rail 621 can drive the guiding plate 3 to move back and forth by pushing the protrusions 322 during the rotation of the second driving member 62. The second driving member 62 comprises a center hole 622, which is aligned with the second adjustment block 633 along an extending direction of the second pin 612, and is used for the second pin 612 passing through, thus the operator can adjust the position of the second adjustment block 633 on the second pin 612. The second pin 612 comprises a second locking groove 6121 on a free end thereof. The second tensioning component 6 further comprises a second retaining ring 64.

When assembling the second tensioning assembly 6, firstly the second pin 612 passes into and through the positioning rod 6316 of the second bracket 631, the second elastic member 632 is sleeved on the positioning rod 6316 and second adjustment block 633 assembles to the end of the second pin 612, then the second retaining ring 64 is buckled with the second locking groove 6121, finally the second driving member 62 is connected to the second bracket 631 by the second fastener 65, making the second knob 61, the second transmission assembly 63 and the second driving member 62 assembled together.

After the second tensioning component 6 is assembled to the housing 1, the second elastic member 632 is in a compressed state and pushes the second transmission assembly 63, enabling the meshing end teeth 6311 of the second transmission assembly 63 to engage with the second inner teeth 611 of the second knob 61, and at the same time the ribs 614 are received in the corresponding grooves 6313.

When the chain 4 is in the loose state, the second knob 61 is forced to rotate, the meshing end teeth 6311 engages with the second inner teeth 611, and the grooves 6313 latches the ribs 614, which enables the second transmission assembly 63 to rotate with the second knob 61. Then, the second transmission assembly 63 drives the second driving member 62 to rotate synchronously, under the cooperation of the second spiral guiding rail 621 and the protrusion 322 on the positioning plate 32, the guiding plate 3 is pushed forward and the chain 4 is tensioned.

When the chain 4 is in the tensioned state, the second knob 61 is continually rotated, the second driving member 62 is no longer rotating along with the second knob 61 due to increased resistance, so the second transmission assembly 63 will no longer rotate. Then skidding occurs between the second inner teeth 611 and the meshing end teeth 6311; at the same time, the side walls 6141 of the ribs 614 and the side end walls 6315 of the ribs 6314 slide relatively, the ribs 614 escape from the corresponding grooves 6313 and a clicking sound is generated. The second knob 61 is rotated so that the second pin 612 presses the guiding plate 3 to fasten the guiding plate 3.

Same as in the first embodiment, the second driving member 62 in the second embodiment may also be an eccentric rotation mechanism such as a one-way cam and a two-way cam, here will not repeat.

Third Implementation

Figure 18:
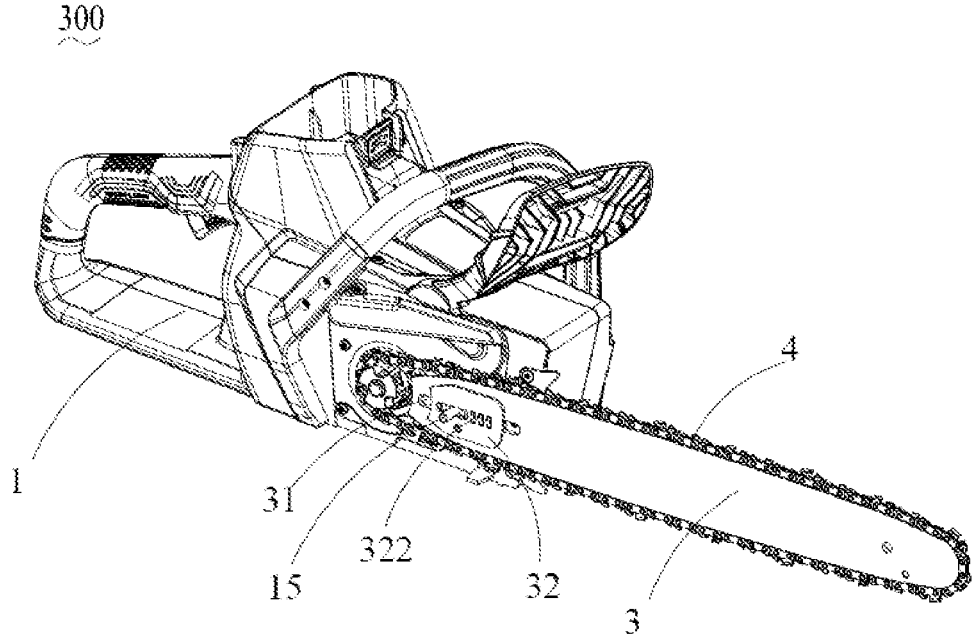
FIG. 18 is a perspective view of a third chain saw according to the third embodiment of the present application, wherein a third tensioning component is removed.
Figure 19:
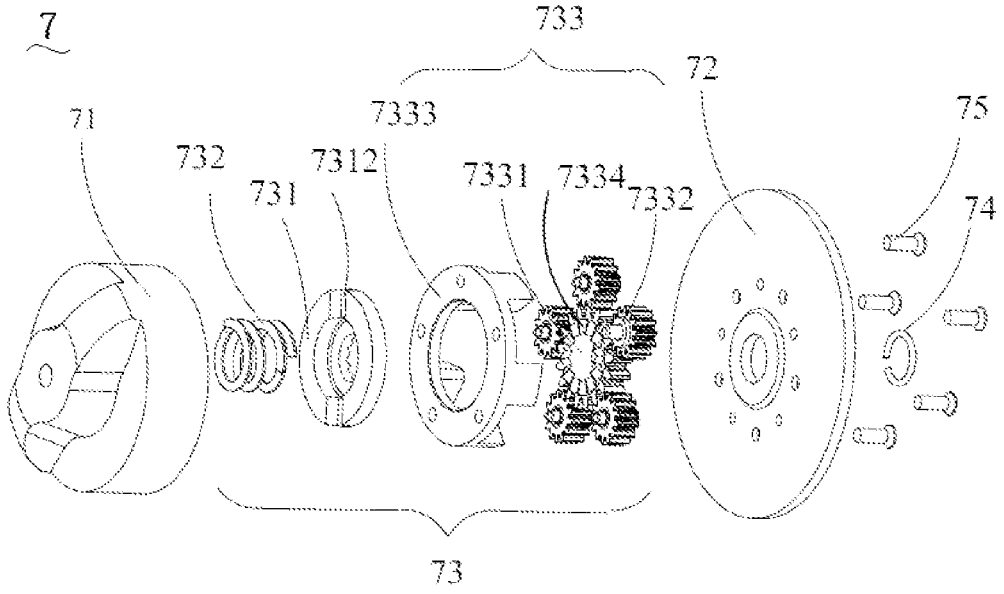
FIG. 19 is a perspective exploded view of the third tensioning component.
Figure 20:
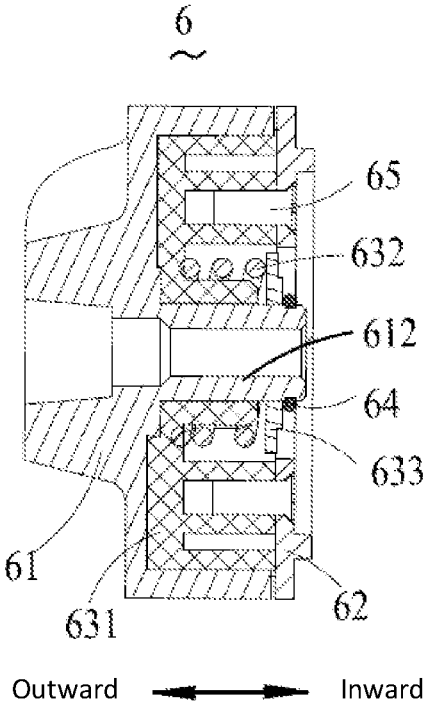
FIG. 20 is a sectional view of the third tensioning component.
Figure 21:
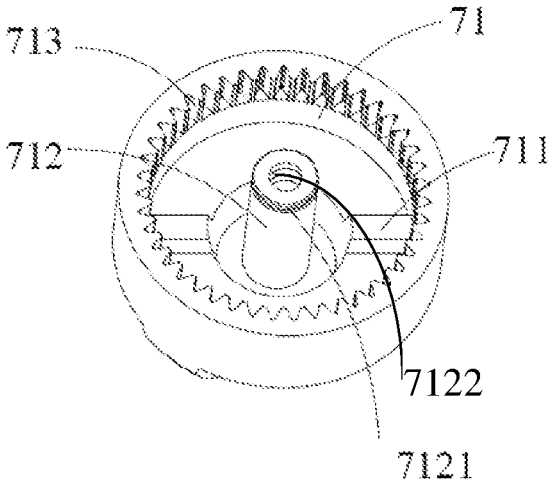
FIG. 21 is a perspective view of a third knob of the third tensioning component, observed from a bottom-up side.
Figure 22:
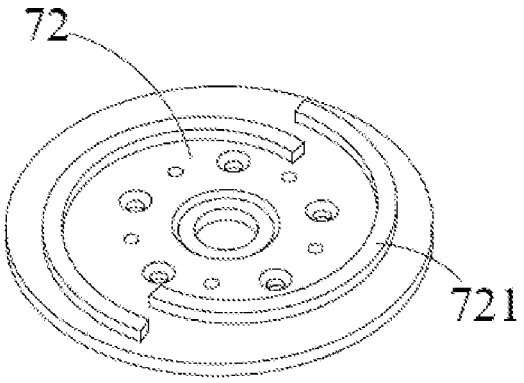
FIG. 22 is a perspective view of a third driving member of the third tensioning component, observed from a bottom-up side.
Figure 23:
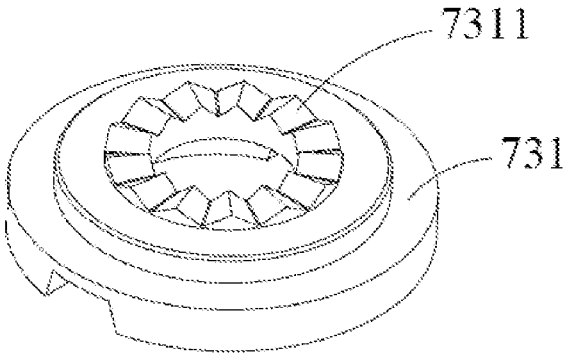
FIG. 23 is a perspective view of a releasing block of the third transmission assembly.

The present invention provides a third chain saw 300 according to a third embodiment. Please refer to FIG. 18 and FIG. 19, the third chain saw 300 comprises a third tensioning component 7, and the third tensioning component 7 drives the guiding plate 3 back and forth to tension the chain saw 4. The third chain saw 300 is basically same as the first chain saw 100 except that the third tensioning component 7 is different from the first tensioning component 5 of the first chain saw 100. For easily understanding, except for the tensioning component, the numeral labels of other structures are used along with that of the first embodiment, and an assembled perspective view of the third chain saw 300 can refer to FIG. 1.

Please refer to FIG. 19 to FIG. 23, the third tensioning component 7 comprises a third knob 71, a third driving member 72, and a third transmission assembly 73 disposed between the third knob 71 and the third driving member 72. When the chain 4 is in a loose state, the third knob 71 drives the third transmission assembly 73 to rotate, and the third transmission assembly 73 drives the third driving member 72 to rotate, then the third driving member 72 pushes the guiding plate 3 to move to tension the chain 4; when the chain 4 is in a tensioned state, the third driving member 72 stays still, the skidding occurs among the components of the third transmission assembly 73, and the driving force of the third knob 71 is released to stop the transmission of torque, details will be given in below.

The third knob 71 is roughly cylindrical, and comprises a resisting block 711 on a side thereof facing the third transmission assembly 73 and a third pin 712. The third pin 712 comprises a third locking groove 7121 on a free end thereof, the third pin 712 further comprises a threaded hole 7122 therein to cooperate with the bolt 15 on the housing 1. An inner ring gear 713 is arranged on a peripheral wall of the third knob 71.

The third driving member 72 is in the shape of a disc, and comprises a third spiral guiding rail 721 on a side thereof opposite to the third knob 71 for matching with the protrusion 322. The third spiral guiding rail 721 and the protrusion 322 are disposed same as the second spiral guiding rail 621 and the protrusion 322 of the second chain saw 200 in the second embodiment, here will not repeat.

The third transmission assembly 73 includes a releasing block 731, a third elastic member 732 and a gear set 733, and the releasing block 731 is disposed between the third elastic member 732 and the gear set 733. The releasing block 731 comprises a resisting groove 7312 on a side thereof facing the third knob 71 for latching with the resisting block 711, so that the third knob 71 can rotate the releasing block 731. In this embodiment, the resisting block 711 is a protrusion, and the resisting groove 7312 is a groove; however, it is understood that the resisting block 711 may be arranged on the releasing block 731, and the resisting groove 7312 may be arranged on the third knob 71. The third knob 71 comprises a plurality of inner teeth 7311 to drive the gear set 733 on a side thereof facing the gear set 733.

One end of the third elastic member 732 abuts the third knob 71, and the other end of the third elastic member 732 abuts the releasing block 731 to make the releasing block 731 abut against the third knob 71. The elastic force exerted by the third elastic member 732 on the releasing block 731 can be freely adjusted by operator, When the third tensioning component 7 is used for a long time, the force exerted by the third elastic member 732 on the releasing block 731 will gradually decrease; at this time, operator can adjust a compressed length of the third elastic member 732, the elastic force provided by the third elastic member 732 is maintained at a certain value to ensure an enough force applied on the releasing block 731. Preferably, the force is 20N. In this embodiment, the third elastic member 732 is a spring, but in other embodiments, the third elastic member 732 may also be a plastic elastic member, an elastic sheet, or the like.

The gear set 733 includes a sun gear 7331, at least one planet gear 7332 and a third bracket 7333 that cooperates with the planet gear 7332. The sun gear 7331 is pivotally mounted on the third knob 71 by setting around the third pin 712, and comprises a plurality of outer teeth 7334 matched with the inner teeth 7311 of the releasing block 731. The planetary gear 7332 is pivotally mounted on the third driving member 42, an inner side of the planetary gear 7332 mashes with the sun gear 7331. The third bracket 7333 covers the outer side of the planetary gear 7332, and the third knob 71 covers the outer side of the third transmission assembly 73. An outer side of the planetary gear 7332 is engaged with the inner ring gear 713 of the third knob 71, and the third bracket 7333 form a plurality of gaps (not labeled), the outer side of the planetary gear 7332 protrudes out of the third bracket 7333 through the gap to engage with the planetary gear 7332.

Preferably, the planetary gears 7332 are evenly distributed around the sun gear 7331 and the number of planetary gears 7332 is 3 or 7 or 8, in such arrangement, the sun gear 7331 and the third driving member 72 can be positioned with uniformly stress.

The third tensioning component 7 comprises a plurality of third fastener 75. When assembling, the third fastener 75 fasten the third bracket 7333 and the third driving member 72, and the planetary gear 7332 is rotatably installed between the third bracket 7333 and the third driving member 72. Then, the third pin 712 of the third knob 71 passes through the third elastic member 732, the releasing block 731, the third bracket 7333, the sun gear 7331 and the third driving member 72. The third tensioning component 7 further includes a third retaining ring 74, which is clamped in a third locking groove 7121 positioned on a free end of the third pin 712.

When the chain 4 is in a loose state, the third knob 71 is rotated and drives the releasing block 731 to rotate synchronously, the inner teeth 7311 of the releasing block 731 is engaging with the outer teeth 7334 of the sun gear 7331 to drive the sun gear 7331 to rotate synchronously. The rotation directions of the third knob 71, the releasing block 731, and the sun gear 7331 are the same. The planet gear 7332 revolves around the sun gear 7331 under the cooperation of the inner ring gear 713 of the third knob 71 and the sun gear 7331, the third bracket 7313 is driven to rotate and drives the third driving member 72 to rotate, then the third spiral guiding rail 721 abuts against the protrusion 322 of the positioning plate 32 to drive the guiding plate 3 to move, so as to tension the chain 4.

When the chain 4 is in a tensioned state, the third knob 71 is continually rotated to drive the releasing block 731 to rotate. At this time, the third driving member 72 and the third bracket 7333 stay still, and the planetary gear 7332 can not revolve around the sun gear 7331, but only can rotate in place as being driven by the inner ring gear 713 of the third knob 71, so that the planetary gear 7332 forces the sun gear 7331 to rotate in a rotation direction opposite to the rotation direction of the releasing block 731. Then skidding occurs between the outer teeth 7334 of the sun gear 7331 and the inner teeth 7311 of the releasing block 731, resulting in a click sound, that is the third transmission assembly 73 skid between parts of itself. The third knob 71 is further continually rotated, the third pin 712 begin to contact the guiding plate 3 and press the guiding plate 3 till the third knob 71 is tightened, that can further fasten the guiding plate 3. It can be understood that there are multiple structures for realizing this function. For example, the guiding plate 3 can be configured to the thickness thereof gradually decreases along its moving direction. The present invention does not enumerate the structures that realize this function.

It can be understood that, similar to the first driving member 52 in the first embodiment, the third driving member 72 may also be the one-way cam exemplified in the first embodiment or an eccentric rotation mechanism such as a two-way cam, and the installation method thereof is the same as that of the third driving member 72 in the embodiment of the present invention, and will not be repeated.

In summary, the tensioning assembly of the chain saw in each embodiment of the present invention comprises a knob, a driving member and a transmission assembly. By rotating the knob, the chain can be tensioned and the guide plate can be fastened, and the operation is simple. Meanwhile, the tensioning component can avoid over-tensioning the chain through various skidding methods, the operator does not need special experience, and the control is more convenient.

The above embodiment is only used to illustrate the present invention and not to limits the technical solutions described in the present invention. The understanding of this specification should be based on those skilled in the art, although the present invention has been described in detail with reference to the above embodiment. However, those skilled in the art should understand that those skilled in the art can still modify or equivalently replace the present invention, and all technical solutions and improvements that do not depart from the spirit and scope of the present invention should be within the scope of the claims of the invention.

What is claimed is:

1. A chain saw, comprising:

a housing;

a guiding plate installed on the housing and being movable forward and backward relatively to the housing;

a chain arranged around the guiding plate;

a power system installed on the housing and driving the chain; and a tensioning component comprising a knob, a driving member and a transmission assembly arranged between the knob and the driving member;

wherein, when the chain is in a loose state, the knob is forced to rotate and drives the transmission assembly to rotate, the transmission assembly then drives the driving member to rotate, and the driving member drives the guiding plate to move to tension the chain; when the chain is in an extension state, the knob is forced to rotate, the driving member stays still, and a skidding inside the tensioning component is generated;

wherein the transmission assembly comprises a releasing block, an elastic member and a gear set, the releasing block engages with the knob, and the elastic member is arranged between the knob and the releasing block, the releasing block comprises a plurality of inner teeth, and the gear set comprises a plurality of outer teeth; when the chain is in the loose state, the knob drives the releasing block to rotate, and the releasing block drives the gear set to rotate through the cooperation of the inner teeth and the outer teeth, then the gear set drives the driving member to rotate; when the chain is in the extension state, the skidding inside the tensioning component is generated between the inner teeth and the outer teeth; and wherein the gear set comprises a sun gear pivot mounted on the knob and at least one planetary gear pivot mounted on the driving member, the knob is arranged outside the gear set, and an inner ring gear is arranged on an inner wall of the knob for matching with the at least one planetary gear.

2. The chain saw according to claim 1, wherein the skidding inside the tensioning component is generated between the transmission assembly and the knob, or between the transmission assembly and the driving member, or between parts of the transmission assembly.

3. The chain saw according to claim 1, wherein the knob comprises a pin with a thread hole, the housing comprises a bolt passing through the guiding plate, and the pin is in threaded connection with the bolt to fix the tensioning component to the housing; and wherein when the chain is in the extension state, rotating the knob enables the pin tightly pressing the guiding plate.

4. The chain saw according to claim 1, wherein the knob includes a pin with an end passing through the transmission assembly and the driving member, and the end is sheathed with a retaining ring.

5. The chain saw according to claim 1, wherein the gear set comprises a bracket arranged outside the planetary gear, at least one gap is arranged on a side wall of the bracket, an outer side of the planetary gear protrudes out of the at least one gap to mesh with the planetary gear.

6. The chain saw according to claim 1, wherein the knob comprises a resisting block, and the releasing block comprises a resisting groove engaging with the resisting block.

7. The chain saw according to claim 1, wherein the driving member comprises at least one spiral guiding rail, or, the driving member is configured to a one-way cam or a two-way cam, and wherein the guiding plate comprises a guiding rail groove and a positioning plate, the positioning plate comprises protrusions matched with the driving member.

8. The chain saw according to claim 1, wherein the transmission assembly comprises a bracket, and the bracket is fixed to the driving member by a plurality of fasteners.

* * * * *